United States Patent [19]

Cho

[11] Patent Number: 4,807,791

[45] Date of Patent: Feb. 28, 1989

[54] APPARATUS FOR ACTUATING A SIDEMOVEMENT CORRECTING MEMBER OF A MACHINE FOR CORRECTING THE SIDEMOVEMENT OF A TRAVELLING SHEET-LIKE ARTICLE

[76] Inventor: Hideyuki Cho, c/o Toyo Machinery Co. Ltd., 4-4-19, Zuiko, Higashiyodogawa-ku, Osaka-shi, Japan

[21] Appl. No.: 838,775

[22] Filed: Mar. 12, 1986

[30] Foreign Application Priority Data

Nov. 29, 1985 [JP] Japan ..... 60-270278

[51] Int. Cl.[4] ..... B65H 23/022; D06C 3/02

[52] U.S. Cl. ..... 226/19; 226/15; 26/76

[58] Field of Search ..... 26/76, 91, 74, 75; 226/15, 18, 19, 20, 21; 74/99 R, 102, 103

[56] References Cited

U.S. PATENT DOCUMENTS

| | | | |
|---|---|---|---|
| 3,216,081 | 11/1965 | Leimer et al. | 26/76 |
| 3,906,262 | 9/1975 | Shichida et al. | 310/12 |
| 4,346,502 | 8/1982 | Cho | 26/76 |
| 4,408,138 | 9/1983 | Okamoto | 310/12 |
| 4,623,807 | 11/1986 | Wakamura | 310/12 |
| 4,644,199 | 2/1987 | Langley | 310/12 |

FOREIGN PATENT DOCUMENTS

| | | |
|---|---|---|
| 58-22248 | 2/1983 | Japan . |
| 58-22249 | 2/1983 | Japan . |

*Primary Examiner*—Stuart S. Levy
*Assistant Examiner*—Steven M. duBois
*Attorney, Agent, or Firm*—Larson and Taylor

[57] ABSTRACT

Apparatus for actuating a sidemovement correcting member of a machine for correcting the sidemovement of a travelling sheet-like article, comprising a linear motor having a scale of a predetermined length and a slider disposed at the bottom of the scale, a casing secured to the outer surface of the slider and put on the slider and the sale for preventing the slider from falling off, and a mounting member for the sidemovement correcting member disposed at the center of the top of the casing.

The apparatus is arranged so that the linear motor is moved or stopped at a predetermined position in quick response to a selvedge detector signal and the like, thus assuring a highly accurate positioning control of the sidemovement correcting member.

5 Claims, 5 Drawing Sheets

APPARATUS FOR ACTUATING A SIDEMOVEMENT CORRECTING MEMBER OF A MACHINE FOR CORRECTING THE SIDEMOVEMENT OF A TRAVELLING SHEET-LIKE ARTICLE

BACKGROUND OF THE INVENTION

Sidemovement correcting members of a machine for correcting the sidemovement of a travelling sheet-like article are generally disposed at the selvedge of a travelling sheet-like article, respectively. When a travelling sheet-like article is displaced to exhibit a sidemovement, these correcting members work to move the selvedges of the travelling sheet-like article to predetermined directions, thereby to correct the travelling to a correct line.

As means for actuating the correcting member of the type above-mentioned, there is conventionally known, for example, an actuator comprising a screw shaft, nut means threadedly connected to the screw shaft, and an electric motor for reversively rotating either the screw shaft or the nut means. The correcting member which is connected to the nut means, is adapted to be moved together with the nut means in a predetermined direction by the reversible rotation of the motor.

The inventor has previously proposed apparatus for actuating a sidemovement correcting member of a machine for correcting the sidemovement of a travelling sheet-like article with the object of making the apparatus in compact design and improving the maneuverability of the apparatus.

As shown in FIG. 7, the apparatus previously proposed by the inventor comprises a reversible motor 1 having a hollow rotary shaft 2, bearings 3 for the shaft 2, a rotor 4 secured to the shaft 2 at its outer periphery, a stator 5 on the outer periphery of the rotor 4 and a casing 6 for housing the members above-mentioned, a screw shaft 7 of a predetermined length and a member 8 put on the screw shaft 7. The member 8 is secured to one end of the hollow rotary shaft 2 with a screw 9, and forms a nut means 11 provided with a circulating passage 10 for a plurality of lubricating balls 12. The screw shaft 7 is inserted into the member 8 and is threadedly connected thereto through the lubricating balls 12. The both ends of the screw shaft 7 is non-rotatably secured to supports 13.

With such arrangement, the forward and reverse rotations of the rotor 4 enable the motor 1 to be reciprocated axially of the screw shaft 7. When a sidemovement correcting member 15 of a machine for correcting the sidemovement of a travelling sheet-like article is secured to a pivot shaft 16*a* of a mounting member 16 pivotally connected to the top of the casing 6 through bearings 14, the apparatus can be utilized as means for reciprocating the correcting member 15 axially of the screw shaft 7. Since this apparatus is constructed so that the motor 1 itself is reciprocated, the entire arrangement is remarkably simplified as compared with a conventional apparatus requiring transmission means ( not shown ) such as belts, pulleys, an external motor. Thus, the entire apparatus can be advantageously forced in contact design. However, the use of a rotary motor as the motor 1 presents the following problems.

The ON and OFF operations of the motor 1 are made, for example, by a signal of detecting the sidemovement of a travelling sheet-like article and a signal of detecting the sidemovement correction, supplied from a detector (not shown) of a sidemovement correcting machine. However, a time delay often occurs between the ON/OFF operation of the motor 1 and the movement/stop of the correcting member 15. In particular, at the time the correcting member 15 is to stop, highly accurate control cannot be expected. In other words, excessive correction is made to a sheet-like article which is travelling in a zigzag line. This leads to the occurrence of another sidemovement of the travelling sheet-like article, or unnecessary movement of the correcting member 15. Moreover, noise due to the rotation of the motor produces another problem.

SUMMARY OF THE INVENTION

The present invention relates to improvements in apparatus for actuating a sidemovement correcting member of a machine for correcting the sidemovement of a travelling sheet-like article, such as a fabric, a metallic thin plate or a paper. The present invention relates to, for example, actuating apparatus to be used as a rotating device for rotating a rotary arm of a tenter for tentering and correcting the sidemovement of a travelling fabric, in a fabric finishing process such as dying and drying.

It is a main object of the present invention to provide apparatus for actuating a sidemovement correcting member of a sidemovement correcting machine, in which a motor to be operated by selvedge detector signals and the like from a detector for detecting a selvedge of a travelling sheet-like article, can be driven or stopped at a predetermined position in quick response to the signals and the like above-mentioned, thus assuring a highly accurate positioning control of the sidemovement correcting member, and in which the motor does not generate noise during its rotation.

The present invention provides apparatus for actuating a sidemovement correcting member of a machine for correcting the sidemovement of a travelling sheet-like article, in which a linear motor having a scale of a predetermined length and a slider at the bottom of the scale is used as a motor for transversely moving a member for correcting the sidemovement of a travelling sheet-like article, a casing is secured to the slider at its lower surface and put on the slider and the scale, in order to prevent the slider from falling off from the scale, and a mounting member for the sidemovement correcting member is disposed at the center of the top of the casing.

The scale may be fixedly disposed. However, dependent on the type of a sidemovement correcting machine, the center of the top of the casing can be horizontally rotatably connected to the mounting member for the correcting member, and only one end of the scale can be pivotally connected to a vertical pivot shaft with the other end of the scale being horizontally rotatable. With such arrangement, the apparatus for actuating a correcting member can actuate the correcting member either in a transverse reciprocal motion or in a transverse horizontal swing (rotation).

According to the apparatus for actuating a sidemovement correcting member of the present invention, the linear motor itself is reciprocated along the scale, so that the sidemovement correcting member mounted on the casing for preventing the slider from falling off from the scale, is moved in the reciprocating direction of the motor with its reciprocation, thereby to correct the sidemovement of a travelling sheet-like article.

According to the present invention, the linear motor to be operated by a selvedge detector signal from a selvedge detector can be securely driven and stopped at a predetermined position in quick response to such signal because of the characteristics inherent in a linear motor. This enables the correcting member to be positionally controlled with high accuracy, thus advantageously achieving a highly accurate correction of the sidemovement of a travelling sheet-like article.

The compact design and simplified structure of the apparatus facilitate the installation, handling and maintenance of the apparatus. The space required for installing the apparatus can be reduced, resulting in economy. The characteristics inherent in a linear motor advantageously reduce noise during the operation of the motor.

DETAILED DESCRIPTION OF THE INVENTION

Figure 1:
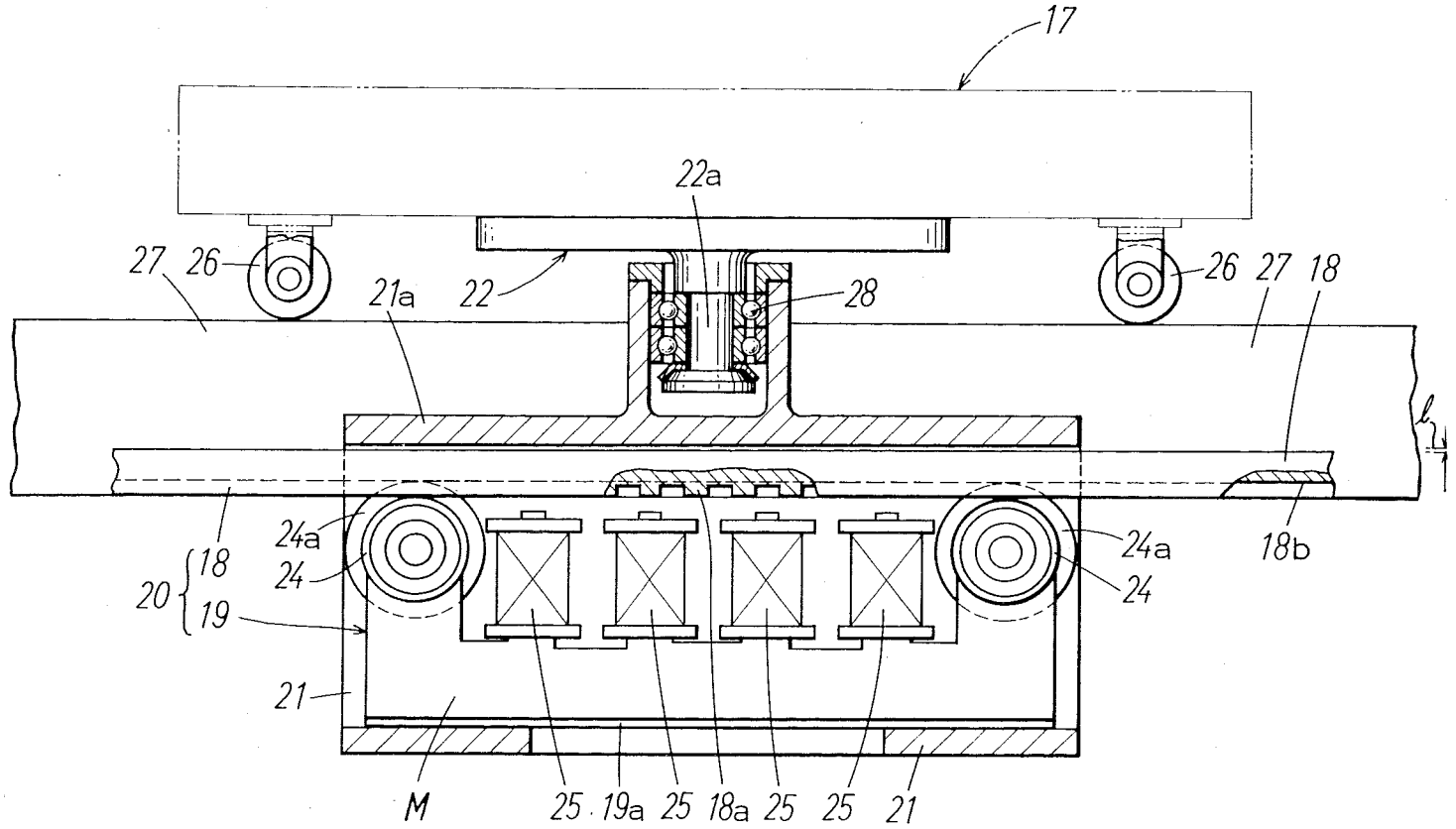
FIG. 1 is a longitudinal section view in front elevation, with portions broken away, of apparatus in accordance with the present invention.

FIGS. 1 to 4 illustrate one embodiment of the apparatus in accordance with the present invention for actuating a sidemovement correcting member 17 of a machine for correcting the sidemovement of a travelling sheet-like article.

This actuating apparatus comprises a linear motor 20 (In this embodiment, a linear pulse motor is shown.) including a stationary scale of a predetermined length 18 and a slider 19 secured to the scale 18 at its bottom side, a casing 21 secured to the lower surface of the slider 19 and put on the slider 19 and the scale 18 for preventing the slider 19 from falling off, and a mounting member 22 at the center on the top of the casing 21, the correcting member 17 adapted to be mounted on the mounting member 22.

Figure 2:
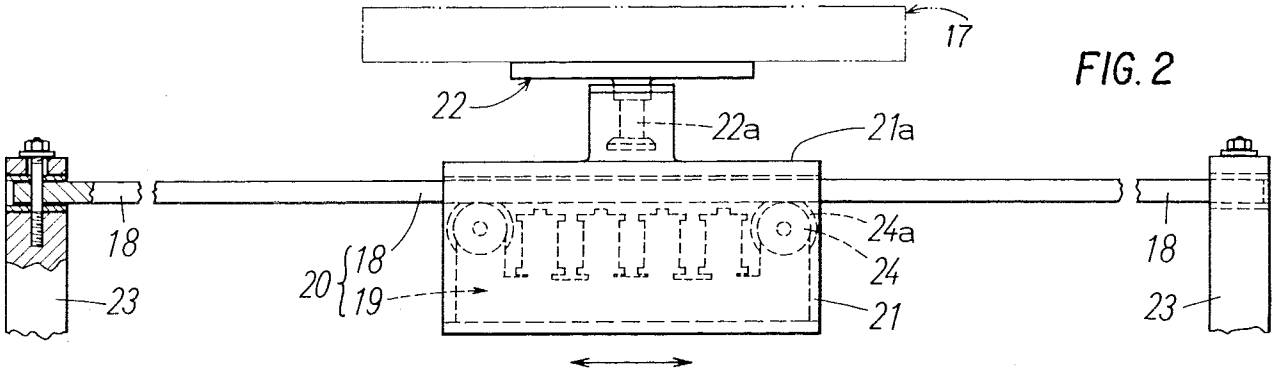
FIG. 2 is a front view with portions broken away illustrating how the apparatus in accordance with the present invention is mounted.
Figure 3:
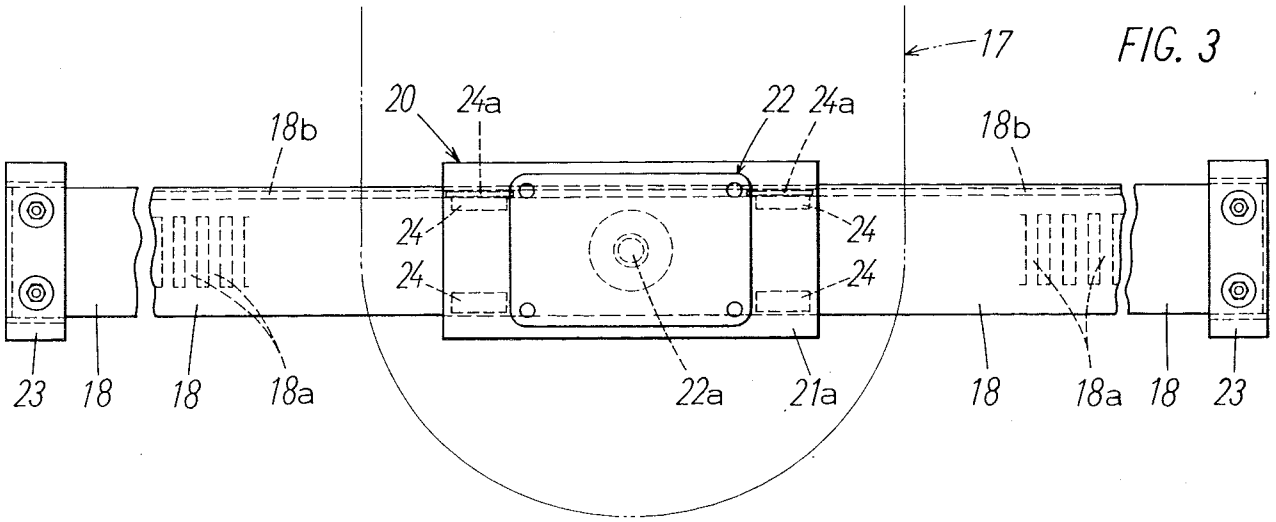
FIG. 3 is a plan view of FIG. 2.
Figure 4:
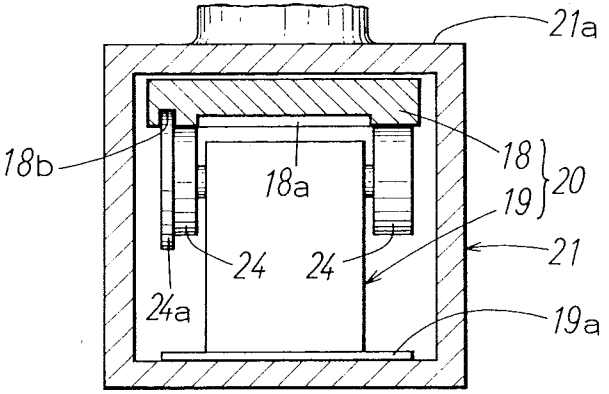
FIG. 4 is a longitudinal section view in side elevation, with portions broken away, of main portions of apparatus in accordance with the present invention.

As shown in FIGS. 2 and 3, the scale 18 is secured, at the both ends thereof, to support frames 23 and has, at its bottom along its substantially entire length, a plurality of teeth portions **18*a* for moving the slider. A guide groove 18*b* is formed in the bottom of the scale 18 at its one side in the longitudinal direction of the scale 18. Four rollers 24 in contact with the bottom of the scale 18 are rotatably attached to the respective four corners of the slider 19 opposite to the scale 18. Out of these four rollers 24, each of two rollers 24 opposite to the guide groove 18*b* of the scale 18 has a guide roller 24*a* which is fitted in the guide groove 18*b*, as shown in FIG. 4. Disposed in the slider 19 are four magnetic poles 25 for moving the slider 19, connected to one another with a permanent magnet M, these four magnetic poles 25 facing to the teeth portions 18*a* of the scale 18. With such arrangement, the slider 19 is disposed as absorbed to the bottom of the scale 18 by the magnetic force of the magnetic poles 25. The slider 19 to be moved based on the principle of linear motor can be moved smoothly and straightly by the slide and guide action of the rollers 24 and the guide rollers 24*a***.

The casing 21 for preventing the slider 19 from falling off is secured to a back plate **19*a* at the bottom of the slider 19 and is put on the scale 18 with a distance l for preventing contact friction provided between the scale 18 and the upper frame 21*a* of the casing 21**.

As mentioned earlier, the slider 19 is disposed as absorbed to the scale 18 by the magnetic force for preventing the slider 19 from falling off from the scale 18. However, strong vibration or the like may cause the slider 19 to fall off from the scale 18. In such case, even if the slider 19 together with the casing 21 has been separated from the scale 18, the upper frame **21*a* prevents the slider 19 from falling off from the scale 18, and the slider 19 can be easily absorbed again to the scale 18. This absorbing force is adjusted so that the slider 19 does not fall off even though the load of the correcting member 17 mounted on the mounting member 22 is applied to the slider 19. As shown in FIG. 1, in order to prevent direct application of the load of the correcting member 17 to the slider 19 through the casing 21, it is desirable to mount two casters 26 on the bottom of the correcting member 17 at its right-hand and left-hand portions, respectively, and to dispose a guide rail 27 for supporting and guiding these casters 26** in the transverse direction.

A pivot shaft **22*a* is vertically disposed at the center of the bottom of the mounting member 22. This pivot shaft 22*a* is supported by thrust bearings 28 at the center of the top of the casing 21, so that the mounting member 22 is horizontally, rotatably attached to the casing 21**.

In the embodiment shown in FIGS. 1 to 4, the scale 18 of the linear motor is secured, at the both ends thereof, to the left-hand and right-hand support frames 23. This embodiment is therefore suitable to the application where the correcting member 17 is reciprocated in a direction parallel with the scale 18 to perform a predetermined correcting operation.

Figure 6:
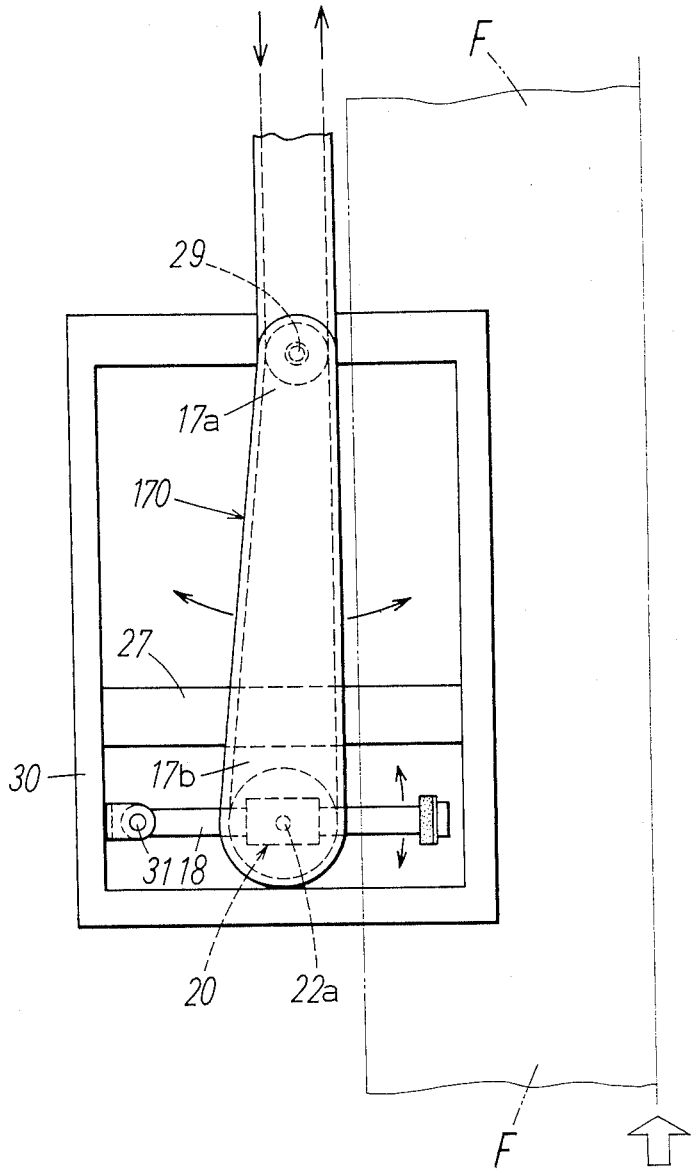
FIG. 6 is a plan view with portions broken away of a tenter to which the apparatus in accordance with the present invention is applied as a mechanism for rotating a rotary arm of the tenter.
Figure 7:
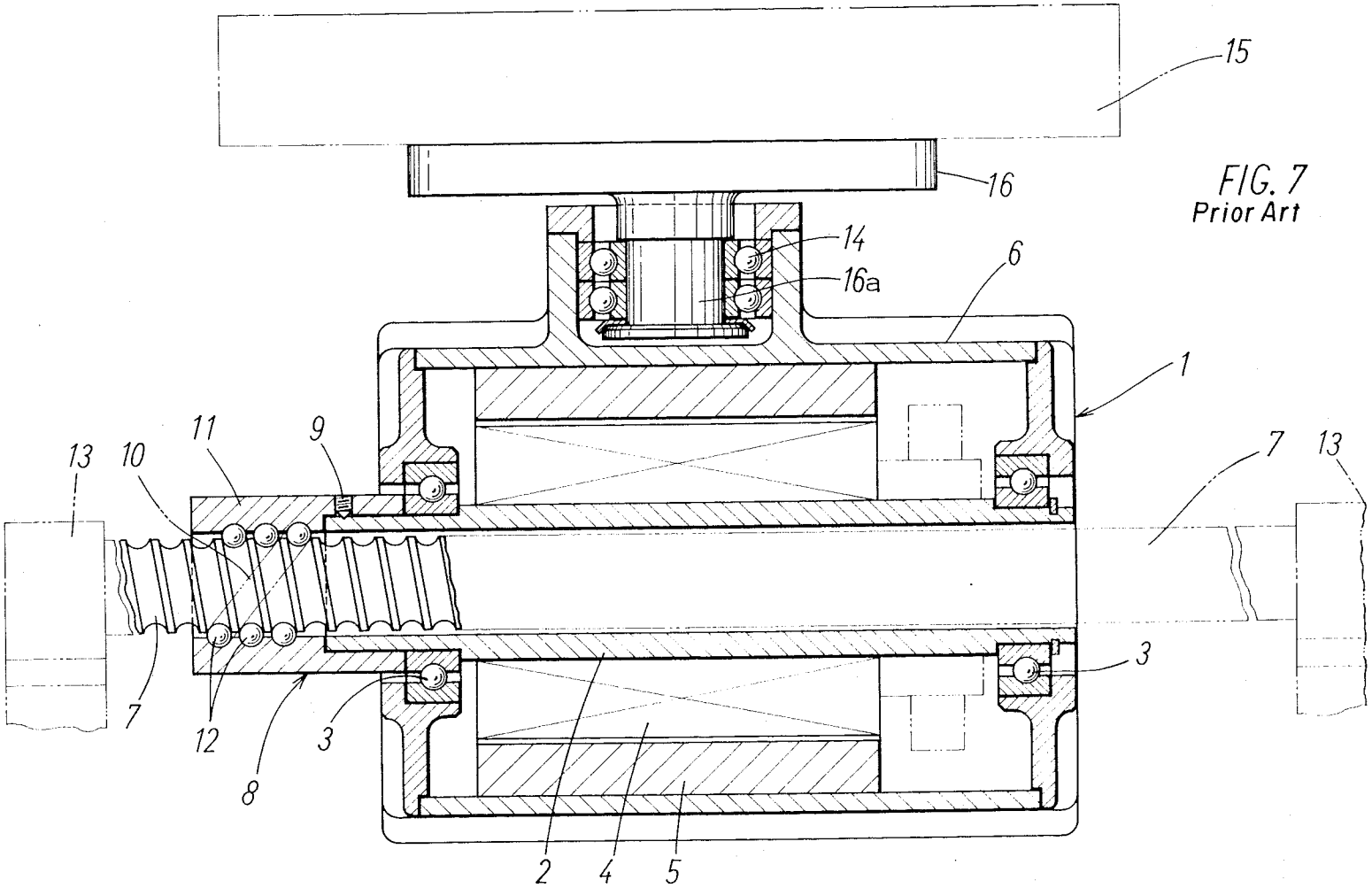
FIG. 7 Prior Art
FIG. 7 is a longitudinal section view in front elevation with portions broken away of a conventional actuating apparatus.

As shown in FIG. 6, however, when the base portion **17*a* of a correcting member or rotating arm 170 of a tenter is disposed in a manner horizontally rotatable around a pivot shaft 29 and the tip portion 17*b* of the arm 170 is transversely swung by the transverse movement of the linear motor 20, the designing can be made so that the arm 170 is swung and the motor 20** is transversely moved.

Figure 5:
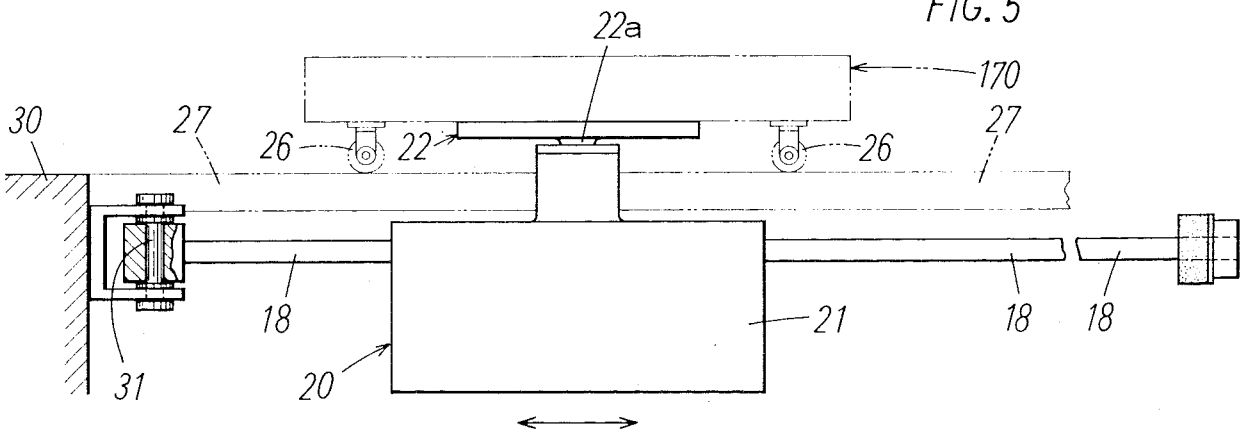
FIG. 5 is a front view with portions broken away illustrating how the apparatus in accordance with the present invention is mounted in a different manner.

That is, as shown in FIG. 5 and FIG. 6 illustrating a second embodiment of the present invention, only one end of the scale 18 can be pivotally connected to a vertical pivot shaft 31 secured to a machine frame 30. With such arrangement, the mounting member 22 for the arm 170 and the scale 18 can be horizontally rotatable around the pivot shafts **22*a* and 31**, respectively.

In FIG. 6, a travelling fabric is generally designated by F.

The linear motor 20 is moved in a left or right direction in response to, for example, a selvedge position detector signal (pulse) from a selvedge detector (not shown). Corresponding to the moving distance of the linear motor 20, the travelling fabric F is moved in a left or right direction by the correcting member 17, so that the sidemovement of the travelling fabric F is corrected.

At this time, the distance of a transverse movement of the motor 20 is in accurate proportion to the input signal, so that the correcting member can be positionally controlled with high accuracy and the entire control system can be simplified.

Moreover, the compact design and simplified structure of the apparatus facilitate mounting of the apparatus to the machine frame or the like and maintenance of the apparatus. The reliability and durability of the apparatus can be improved and the space required for installing the apparatus can be reduced, resulting in economy. Further, the noise generated from the motor can be reduced because of the characteristics inherent in a linear motor.

It is to be noted that the present invention is not limited to the preferred embodiments of the invention, which have been described and illustrated by way of example. Variations and modifications of the invention should be included in the present invention without departing from the spirit and the scope of the attached claims.

What is claimed is:

1. An apparatus for actuating a sidemovement correcting member of a machine for correcting the sidemovements of a traveling sheet, comprising:

a scale of a predetermined length, located on the machine near the side of the traveling sheet, a slider mounted on the scale for movement therealong, a casing secured to the slider and extending over the top of the scale, a linear motor mounted on the slider, said linear motor having magnets located just beneath the scale and magnetically urging the slider toward the scale, said linear motor being operable to move the slider along the scale, said slider also having a set of wheels engaging the bottom of the scale and urged thereagainst by the magnetic force of the magnets, the top of the casing normally spaced above the top surface of the scale, so as to avoid frictional contact therewith when the wheels are against the bottom of the scale, and said top of the casing comprises means for preventing the slider from falling off the scale when the wheels are separated from the bottom of the casing, a set of rollers extending vertically between the connecting member and a fixed portion of the frame to limit movement of the connecting member toward the casing, and hence limit the load of the connecting member on the casing, while permitting low friction relative horizontal movement between the connecting member and the casing, and a mounting member connecting the top of the casing to the sidemovement correcting member, such that the sidemovement correcting member is moved as the slider moves along the scale under the action of the linear motor.

2. An apparatus according to claim 1, wherein the scale is fixedly disposed with respect to the machine.

3. An apparatus according to claim 1, wherein the said top of the casing includes a pivotal connection to the mounting member permitting rotational movement of the mounting member relative to the casing about a vertical axis.

4. An apparatus according to claim 3, including thrust bearings in the said pivotal connection to absorb thrust forces of the member relative to the casing in a vertical direction.

5. An apparatus according to claim 4, wherein one end of the scale is pivotally connected through a pivot shaft to the machine, such that the mounting member and the scale are rotatable about their respective vertical pivot axis.

* * * * *